US008232924B2

(12) United States Patent
Bucca et al.

(10) Patent No.: US 8,232,924 B2
(45) Date of Patent: Jul. 31, 2012

(54) BROADBAND PATCH ANTENNA AND ANTENNA SYSTEM

(75) Inventors: Steven Bucca, Westminster, CO (US); Mike Gawronski, Minneapolis, MN (US)

(73) Assignee: Alliant Techsystems Inc., Arlington, VA (US)

( * ) Notice: Subject to any disclaimer, the term of this patent is extended or adjusted under 35 U.S.C. 154(b) by 442 days.

(21) Appl. No.: 12/465,835

(22) Filed: May 14, 2009

(65) Prior Publication Data

US 2010/0007561 A1 Jan. 14, 2010

Related U.S. Application Data

(60) Provisional application No. 61/055,728, filed on May 23, 2008.

(51) Int. Cl.
*H01Q 1/38* (2006.01)

(52) U.S. Cl. ..... 343/700 MS; 343/702

(58) Field of Classification Search ..... 343/700 MS, 343/702, 770

See application file for complete search history.

(56) References Cited

U.S. PATENT DOCUMENTS

| | | | |
|---|---|---|---|
| 4,259,670 | A | 3/1981 | Schiavone |
| 4,356,492 | A | 10/1982 | Kaloi |
| 4,587,524 | A | 5/1986 | Hall |
| 4,684,953 | A | 8/1987 | Hall |
| 6,133,879 | A | 10/2000 | Grangeat et al. |
| 6,300,906 | B1 | 10/2001 | Rawnick et al. |
| 6,320,542 | B1 | 11/2001 | Yamamoto et al. |
| 6,392,600 | B1 | 5/2002 | Carson et al. |
| 6,496,148 | B2 | 12/2002 | Ngounou Kouam et al. |
| 6,930,639 | B2 | 8/2005 | Bauregger et al. |
| 6,946,995 | B2 | 9/2005 | Choi et al. |
| 7,084,815 | B2 | 8/2006 | Phillips et al. |
| 7,099,686 | B2 | 8/2006 | Ro et al. |
| 7,212,163 | B2 | 5/2007 | Huang et al. |

(Continued)

FOREIGN PATENT DOCUMENTS

EP 0924797 A1 6/1999

(Continued)

OTHER PUBLICATIONS

Dubost, G., et al., "Analysis of a Slot Microstrip Antenna," IEEE Transactions on Antennas and Propagation, vol. AP-34, No. 2, Feb. 1986, pp. 155-163.

(Continued)

*Primary Examiner* — Tan Ho
(74) *Attorney, Agent, or Firm* — TraskBritt

(57) ABSTRACT

A patch antenna includes a ground plane on a surface of a substrate. Patch radiators are formed on another surface of the substrate. Each patch radiator includes tuning slots extending from an edge of the patch radiator toward an interior section such that the slot is separate from a feed point of the patch radiator. In some embodiments, the patch antenna includes a first feed-through conductor disposed through the ground plane and substrate and coupled to the patch radiator. In some embodiments the patch antenna with the first feed-through conductor is a razor patch antenna. An antenna system includes a patch antenna and a transceiver board, which includes a substrate and a ground plane on the substrate. A second feed-through conductor runs through the ground plane and transceiver substrate to connect to a transceiver device. The transceiver board and patch antenna are abutted such that the first and second feed-through conductors connect.

23 Claims, 6 Drawing Sheets

U.S. PATENT DOCUMENTS

| | | | | |
|---|---|---|---|---|
| 7,295,167 | B2 | 11/2007 | Aminzadeh et al. | |
| 7,564,411 | B2 * | 7/2009 | Piisila et al. | 343/702 |
| 2004/0053635 | A1 * | 3/2004 | Haapala et al. | 455/522 |
| 2006/0097922 | A1 * | 5/2006 | Mahmoud | 343/700 MS |

FOREIGN PATENT DOCUMENTS

| | | | |
|---|---|---|---|
| EP | 0978729 | A2 | 2/2000 |
| EP | 1172885 | A1 | 1/2002 |
| EP | 1307078 | A2 | 5/2003 |
| EP | 1950831 | A1 | 7/2008 |
| GB | 2266192 | A | 10/1993 |

OTHER PUBLICATIONS

PCT International Search Report for International Application No. PCT/US2009/043904, mailed Sep. 30, 2009.

Partial International Search Report for International Application No. PCT/US2009/043904, mailed Aug. 6, 2009.

* cited by examiner

BROADBAND PATCH ANTENNA AND ANTENNA SYSTEM

CROSS-REFERENCE TO RELATED APPLICATION

This application claims the benefit of U.S. Provisional Patent Application Ser. No. 61/055,728, filed May 23, 2008 and entitled BROADBAND PATCH ANTENNA, the disclosure of which application is incorporated by reference herein in its entirety.

TECHNICAL FIELD

Embodiments of the present invention relate generally to antennas and antenna systems. More specifically, embodiments of the present invention relate to microstrip patch antennas.

BACKGROUND

Antennas are used to receive or radiate electromagnetic energy. Generally, the antenna forms part of a communication system and the electromagnetic energy carries information in the form of a signal on a carrier signal at one or more desired frequencies.

A patch antenna is one type of antenna that gets its name from the fact that is essentially a metal patch disposed over a ground plane. The ground plane and metal patch are separated by a dielectric, which may be air, foam or other suitable dielectric substrate. The electromagnetic energy is received by, or radiated from, the metal patch. A combination of the dielectric constant, size of the patch, size of the ground plane, and spacing between the ground plane and patch determine a resonant frequency for the patch antenna. Patch antennas are popular because they are easy to fabricate using lithographic patterning such as conventional printed circuit board etching and semiconductor processing.

A conventional patch antenna 10 is illustrated in FIGS. 1A and 1B with a top view and a side view, respectively. The patch antenna 10 includes a substrate 14, a ground plane 16, and a patch radiator 12. A feed line 18 couples to the patch radiator. Generally, the feed line 18 connects the patch antenna 10 to an impedance-controlled connector, an impedance-controlled cable, or a combination thereof.

As stated earlier, patch antennas are widely used because they are relatively easy and inexpensive to fabricate. However, patch antennas generally have a relatively narrow bandwidth. Consequently, conventional patch antennas may not be as useful in applications requiring a wider bandwidth. In addition, most patch antennas generally include a connection from the antenna board to another board for receiving a signal from the antenna. These off-board connections to patch antennas can be difficult because the impedance must be carefully matched to the antenna.

In an effort to increase bandwidth, some patch antennas do not use a substrate. Instead, these patch antennas suspend the metal patch in air above the ground plane with spacers. These air-spaced patch antennas can achieve a wider bandwidth. However, because of the spacers, air-spaced patch antennas consume much more space and are often less rugged than substrate-based patch antennas.

There is a need for patch antennas that have increased bandwidth compared with currently available patch antennas. In addition, there is a need for an enhanced connection arrangement for patch antennas. Finally, there is a need for a broadband patch antenna having the favorable size and durability characteristics of a substrate-based antenna.

BRIEF SUMMARY

Embodiments of the present invention comprise patch antennas with increased bandwidth and patch antennas that include efficient connection arrangements to other electrical elements in an antenna system, while still providing the size and durability advantages of a substrate-based system.

An embodiment of the invention is a patch antenna including a dielectric substrate and a grounding conductor plane formed on a first surface of the dielectric substrate. At least one patch radiator is formed on a second surface of the dielectric substrate. Each of the patch radiators includes a feed point connected to a first edge of the patch radiator and at least one tuning slot extending from an edge of the patch radiator at least partially toward an interior section of the patch radiator. The at least one tuning slot is separate from the feed point and configured to enhance a bandwidth of the patch antenna.

Another embodiment of the invention is a patch antenna including a grounding conductor plane disposed on a first surface of a dielectric substrate and a patch radiator disposed on a second surface of the dielectric substrate. The patch antenna also includes a feed-through conductor disposed through the dielectric substrate and the grounding conductor plane. The feed-through conductor is insulated from the grounding conductor plane and operably couples the feed line to the patch radiator.

Another embodiment of the invention is a patch antenna including a first dielectric substrate having a first patch radiator disposed thereon and a second dielectric substrate having a razor patch radiator disposed thereon. A plastic spacer substrate having a first side and a second side is sandwiched between the first dielectric substrate and the second dielectric substrate such that the first radiator patch abuts the first side and the razor patch radiator abuts the second side. A feed-through conductor is disposed through the first dielectric substrate and operably couples to the first patch radiator.

Yet another embodiment of the invention is an antenna system including a patch antenna and a transceiver board. The patch antenna includes a grounding conductor plane disposed on a first surface of a dielectric substrate and a patch radiator disposed on a second surface of the dielectric substrate. A first feed-through conductor is disposed through the dielectric substrate and is electrically insulated from the grounding conductor plane. A feed line connects the first feed-through conductor to the patch radiator. The transceiver board includes a transceiver substrate and a ground plane at least partially covering one surface of the transceiver substrate. A second feed-through conductor is disposed through the transceiver substrate and is electrically insulated from the ground plane. A transceiver device is disposed on another surface of the transceiver substrate and is operably coupled to the second feed-through conductor. The transceiver board is disposed adjacent the patch antenna such that the ground plane abuts and electrically couples to the grounding conductor plane and the first feed-through conductor operably couples to the second feed-through conductor.

Yet another embodiment of the invention is an antenna system including a patch antenna and a transceiver board. The patch antenna includes a first dielectric substrate having a first surface, a second surface, and a first patch radiator disposed on the first surface. A second dielectric substrate includes a razor patch radiator disposed thereon. A plastic spacer substrate has a first side and a second side and is sandwiched between the first dielectric substrate and the second dielectric substrate such that the first surface abuts a third surface and the razor patch radiator abuts a fourth surface. A first feed-through conductor is disposed through the first dielectric substrate and operably couples to the first patch radiator. The transceiver board includes a transceiver substrate and a ground plane at least partially covering one surface of the transceiver substrate. A second feed-through conductor is disposed through the transceiver substrate and is electrically insulated from the ground plane. A transceiver device is disposed on another surface of the transceiver substrate and is operably coupled to the second feed-through conductor. The transceiver board is disposed adjacent the patch antenna such that the ground plane abuts the second surface and the first feed-through conductor operably couples to the second feed-through conductor.

DETAILED DESCRIPTION OF PREFERRED EMBODIMENTS

Figure 1A:
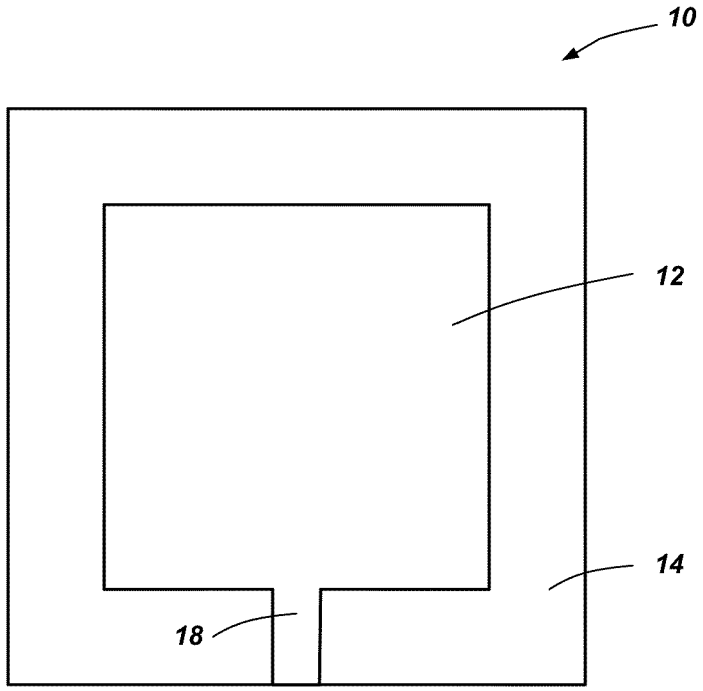
FIG. 1A (Prior Art)
FIGS. 1A and 1B illustrate a conventional patch antenna.
Figure 1B:
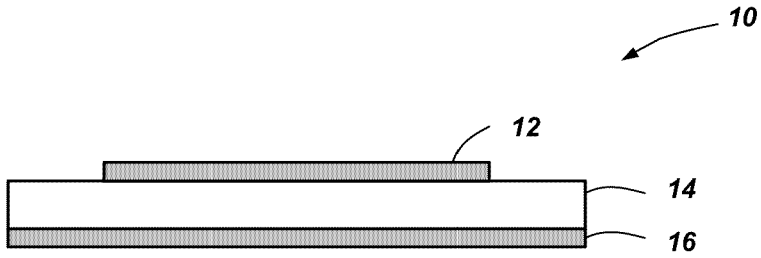
FIG. 1B (Prior Art)

Embodiments of the present invention comprise patch antennas with increased bandwidth and patch antennas that include efficient connection arrangements to other electrical elements in an antenna system, while still providing the size and durability advantages of a substrate-based system.

In the following detailed description, reference is made to the accompanying drawings which form a part hereof, and in which is shown by way of illustration specific embodiments in which the invention may be practiced. These embodiments are described in sufficient detail to enable those of ordinary skill in the art to practice the invention. It should be understood, however, that the detailed description and the specific examples, while indicating examples of embodiments of the invention, are given by way of illustration only and not by way of limitation. From this disclosure, various substitutions, modifications, additions, rearrangements, or combinations thereof within the scope of the present invention may be made and will become apparent to those skilled in the art.

In this description, circuits, logic, and functions may be shown in block diagram form in order not to obscure the present invention in unnecessary detail. Additionally, block designations and partitioning of functions between various blocks are examples of specific implementations. It will be readily apparent to one of ordinary skill in the art that the present invention may be practiced by numerous other partitioning solutions.

In accordance with common practice, the various features illustrated in the drawings may not be drawn to scale. Accordingly, the dimensions of the various features may be arbitrarily expanded or reduced for clarity. In addition, some of the drawings may be simplified for clarity. Thus, the drawings may not depict all of the components of a given apparatus (e.g., device) or method. In addition, like reference numerals may be used to denote like features throughout the specification and figures.

In this description, some drawings may illustrate signals as a single signal for clarity of presentation and description. Persons of ordinary skill in the art will understand that the signal may represent a bus of signals, wherein the bus may have a variety of bit widths and the present invention may be implemented on any number of data signals including a single data signal.

Figure 2A:
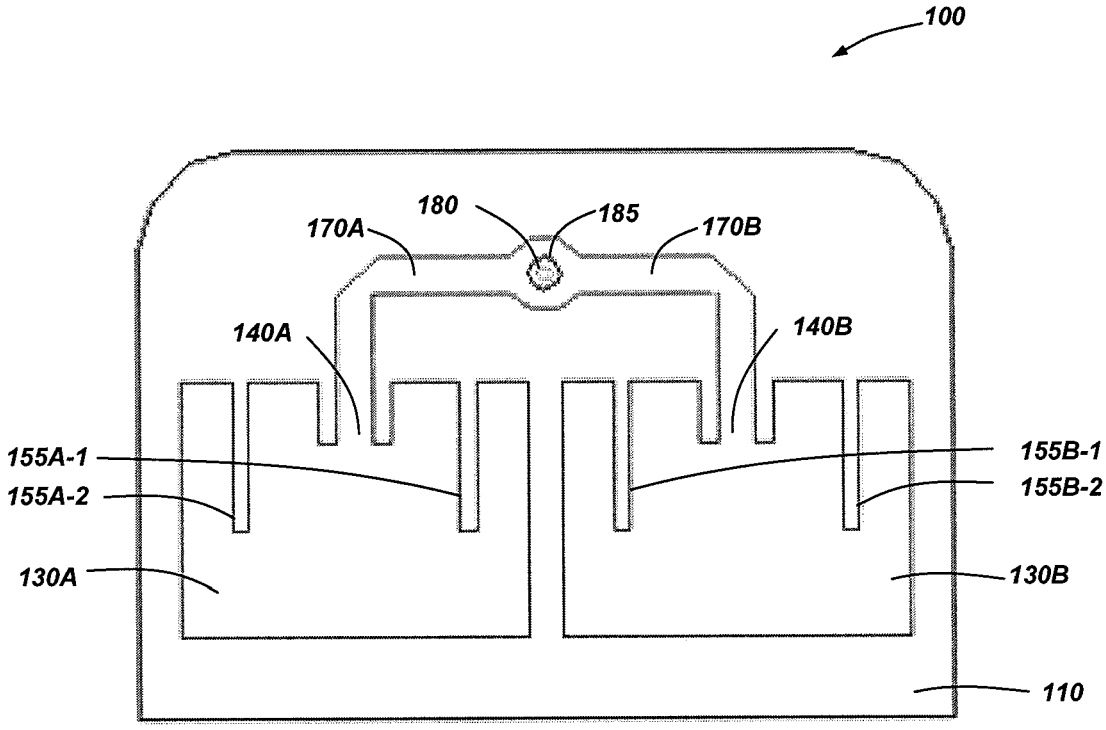
FIGS. 2A and 2B illustrate a patch antenna according to one or more embodiments of the present invention.
Figure 2B:
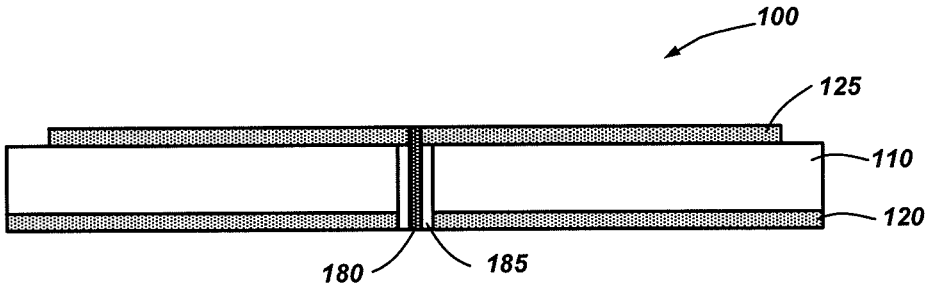

FIGS. 2A and 2B illustrate a patch antenna 100 according to one or more embodiments of the present invention in a top view and a side view, respectively. A dielectric substrate 110 includes a grounding conductor plane 120 on a bottom surface of the dielectric substrate 110. A 1×2 array of patch radiators (130A and 130B) are disposed on a top surface of the dielectric substrate 110. Those of ordinary skill in the art will recognize that the patch antenna 100 may be configured with a single patch radiator or additional patch radiators, such as, for example only, in a 2×2 array or a 1×4 array.

Each patch radiator (130A and 130B) includes a feed point (140A and 140B) where a microstrip feed line (170A and 170B) connects to the patch radiator (130A and 130B). In the embodiment of FIGS. 2A and 2B, the feed points (140A and 140B) are recessed slightly into the interior portion of the patch radiators (130A and 130B). This small recess may assist in providing impedance matching between the patch radiators (130A and 130B) and the feed lines (170A and 170B).

In FIG. 2B a conductor layer 125 is illustrated, which includes the patch radiators (130A and 130B) and the feed lines (170A and 170B).

Conventional foam and air separators may be more difficult to manufacture and less rugged. Consequently, in some embodiments of the present invention the dielectric substrate 110 may be a relatively thin sheet of suitable low-loss dielectric materials. In one embodiment, the dielectric substrate 110 may include a polytetrafluoroethylene (PTFE) based substrate material. In some embodiments of the present invention, increased bandwidth for the patch antenna 100 is achieved using tuning slots on the patch radiators (130A and 130B).

Each patch radiator (130A and 130B) includes a pair of tuning slots 155 positioned along the edge of the patch radiator (130A and 130B) that also includes the feed points (140A and 140B) and on opposite sides of the feed points (140A and 140B). The tuning slots 155 extend from the edge toward an interior portion of the patch radiator 130. Thus, patch radiator 130A includes tuning slots 155A-1 and 155A-2. Similarly, patch radiator 130B includes tuning slots 155B-1 and 155B-2. These tuning slots 155 modify the resonance characteristics of the patch antenna 100 to increase the overall impedance bandwidth of the antenna. Tuning may be accomplished by modifying the slot length (i.e., the length that the slot extends from the edge into the interior portion), the slot width, the slot position, or combinations thereof. In addition, while not illustrated, those of ordinary skill in the art will recognize that there may be only one slot. Furthermore, the slots may be positioned on another edge of the patch radiator (130A and 130B) to tune the resonance characteristics. As non-limiting examples, one or more tuning slots may be placed on the edge opposite from the edge with the feed points (140A and 140B) or one or more tuning slots may be placed on the side edges relative the edge with the feed points (140A and 140B).

In conventional patch antennas, the feed line connects the patch antenna to an impedance-controlled connector (e.g., SMA/SMB connectors), an impedance-controlled cable (e.g., coaxial cables), or a combination thereof. As electromagnetic waves travel through various parts of an antenna system (e.g., the antenna, feed lines, and other elements connected to the antenna), the waves may encounter differences in complex impedances. This mismatch in complex impedance between different elements can cause some of energy from the electromagnetic radiation to reflect back to the source, forming a standing wave in the feed line and potentially reducing performance for the antenna system. Thus, it can be important to minimize impedance mismatches. Furthermore, attaching cables and connectors to an antenna may make the manufacturing process more difficult and result in a larger size for an antenna system.

To minimize impedance mismatches, ease manufacturing issues, and provide a compact form factor, some embodiments of the present invention may use a feed-through connection between the feed lines on one side of the dielectric substrate and a connection on the ground plane side of the antenna substrate that is insulated from the ground plane. As will be explained below, this through-substrate connection enables a more direct connection to other devices in the antenna system, which reduces connection transitions and potential impedance mismatches. The feed-through connection includes an insulated hole 185 with a feed-through conductor 180 disposed in the insulated hole 185. Thus, the feed-through conductor 180 connects to the feed lines (170A and 170B) on one side of the dielectric substrate 110 and is exposed for connection on the other side of the dielectric substrate 110.

Figure 3:
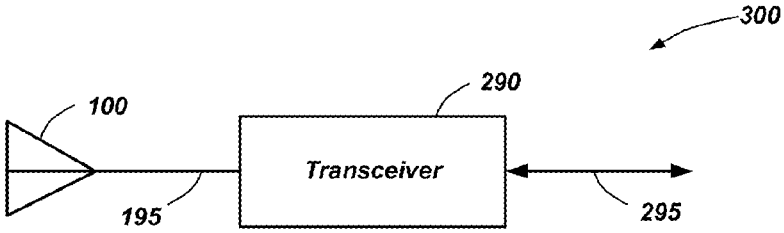
FIG. 3 is a simplified block diagram of an antenna system.

FIG. 3 is a simplified block diagram of an antenna system. The antenna system includes a patch antenna 100, a feed line connection 195 coupling the patch antenna 100 to a transceiver device 290. The transceiver device 290 may condition the signal by, for example, amplifying and filtering the signal from the patch antenna 100. The transceiver device 290 includes a communication signal 295 for connection to a signal processor (not shown) or other suitable device for transmitting or receiving the conditioned signal. As a non-limiting example, the transceiver device 290 may be a Monolithic Microwave Integrated Circuit (MMIC). The MMIC is a complete transceiver and contains functions well known in the art for a transceiver. Thus, the MMIC chip may include functions, such as, for example, a voltage controlled oscillator, a power amplifier, an active circulator, and a mixer.

While embodiments described herein use a transceiver such that the antenna can receive and transmit a signal, those of ordinary skill in the art will recognize that the antenna system also may be configured as just a receiver or just a transmitter.

Figure 4:
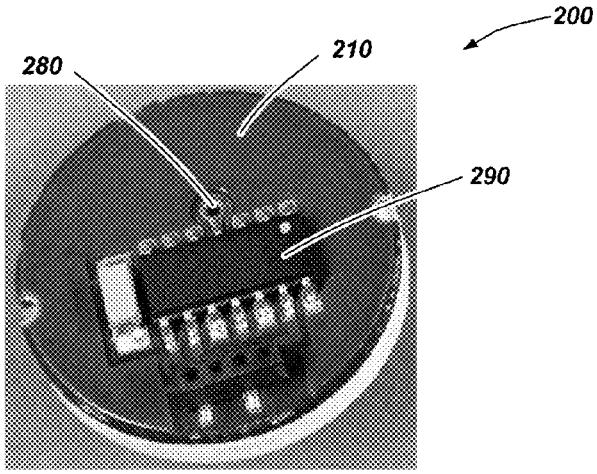
FIG. 4 illustrates a transceiver board according to one or more embodiments of the present invention.

FIG. 4 illustrates a transceiver board 200 according to one or more embodiments of the present invention. The transceiver board 200 includes a transceiver substrate 210 with a transceiver feed-through 280 (also referred to herein as a second feed-through conductor) and a transceiver device 290 disposed on the transceiver substrate 210. The transceiver board 200 is configured to physically and electrically couple to the patch antenna 100.

Figure 5:
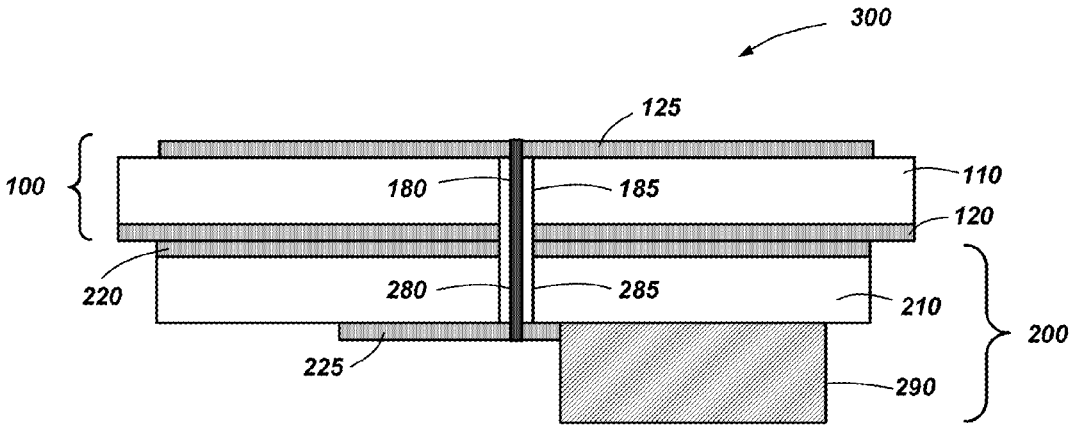
FIG. 5 illustrates a side view of an antenna system including a patch antenna and a transceiver board according to one or more embodiments of the present invention.

FIG. 5 illustrates a side view of an antenna system 300 including a patch antenna 100 and transceiver board 200 according to one or more embodiments of the present invention. In further description of the transceiver board 200 with respect to FIG. 5, the transceiver device 290 is shown disposed on a bottom side of the transceiver substrate 210. A conductor layer 225 couples the transceiver device 290 to the second feed-through conductor 280 and possibly to other devices (not shown) on the transceiver board 200. As with the first feed-through conductor 180, the second feed-through conductor 280 is surrounded by an insulated hole 285 to insulate the second feed-through conductor 280 from the transceiver substrate 210 and a ground plane 220 disposed on an opposite side from the transceiver device 290.

The patch antenna 100 and the transceiver board 200 are configured to be abutted against one another such that the grounding conductor plane 120 of the patch antenna 100 connects with the ground plane 220 of the transceiver board 200. Furthermore, the first feed-through conductor 180 aligns with the second feed-through conductor 280 to form a continuous impedance-controlled signal connection between the patch radiators on the patch antenna 100 and the transceiver device 290 on the transceiver board 200.

As non-limiting examples, the ground plane 220 and grounding conductor plane 120 may be coupled together with a conductive paste, a conductive adhesive, a solder connection, or combinations thereof.

The first feed-through conductor 180 and the second feed-through conductor 280 may be coupled as a solder connection. Alternatively, a single conductive feed-through pin may act as both the first feed-through conductor 180 and the second feed-through conductor 280 and be soldered into place within the insulated hole 185 and insulated hole 285.

Figure 6:
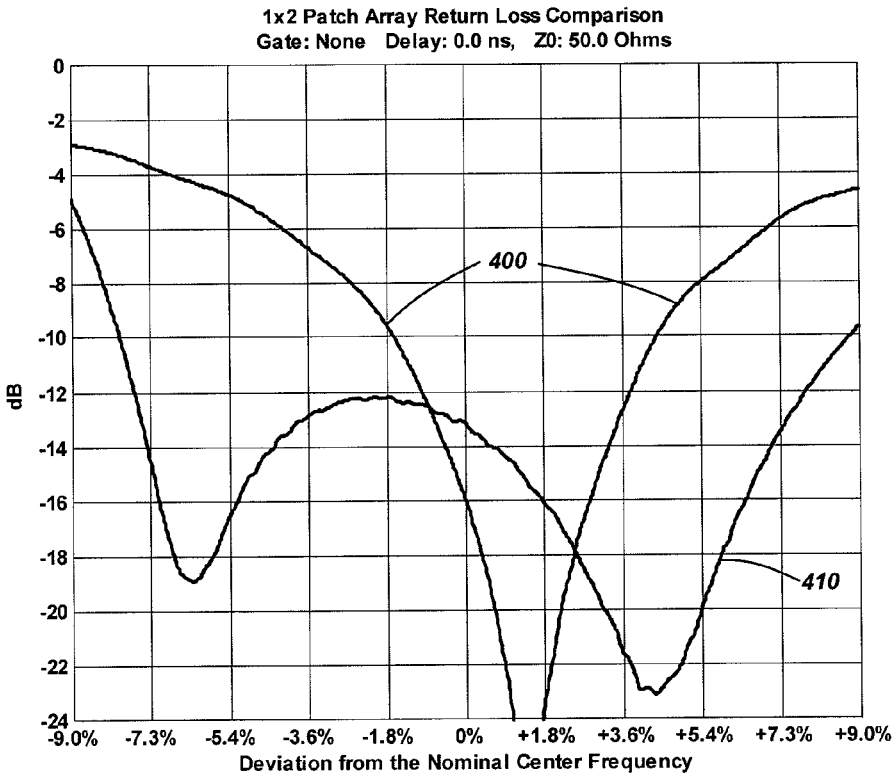
FIG. 6 is a graph illustrating return loss for the patch antenna of FIGS. 2A and 2B.

FIG. 6 is a graph illustrating return loss for the patch antenna of FIGS. 2A and 2B. The return loss is illustrated as deviation from a nominal frequency. As a non-limiting example, the nominal frequency for the patch antenna of FIGS. 2A and 2B may be about 5.6 GHz. In antenna communication systems, return loss is a measure of power reflected in the antenna system relative to power transmitted and generally indicates the efficiency of passing a signal at any given frequency. Thus, the return loss graph of FIG. 6 illustrates the signal passing performance across a bandwidth of interest.

A conventional return loss 400 is illustrated for a 1 X 2 patch array without tuning slots configured to resonate at about the same frequency and with the same dielectric substrate as the embodiment of the present invention illustrated in FIGS. 2A and 2B. Patch antenna return loss 410 illustrates response characteristics of the patch antenna 100 of FIGS. 2A and 2B including the tuning slots 155. As can be seen, return loss 410 provides for significant bandwidth improvement over the conventional return loss 400. For example, at a return loss of −10 dB, relative to the conventional return loss 400, the patch antenna return loss 410 has a bandwidth that is about 6.3% broader on the low-frequency side and about 4.5% broader on the high-frequency side to give an overall bandwidth increase of about 10.8%. As another example, at a return loss of −12 dB, relative to the conventional return loss 400, the patch antenna return loss 410 has a bandwidth that is about 6.5% broader on the low-frequency side and about 4.0% broader on the high-frequency side to give an overall bandwidth increase of about 10.5%.

Figure 7A:
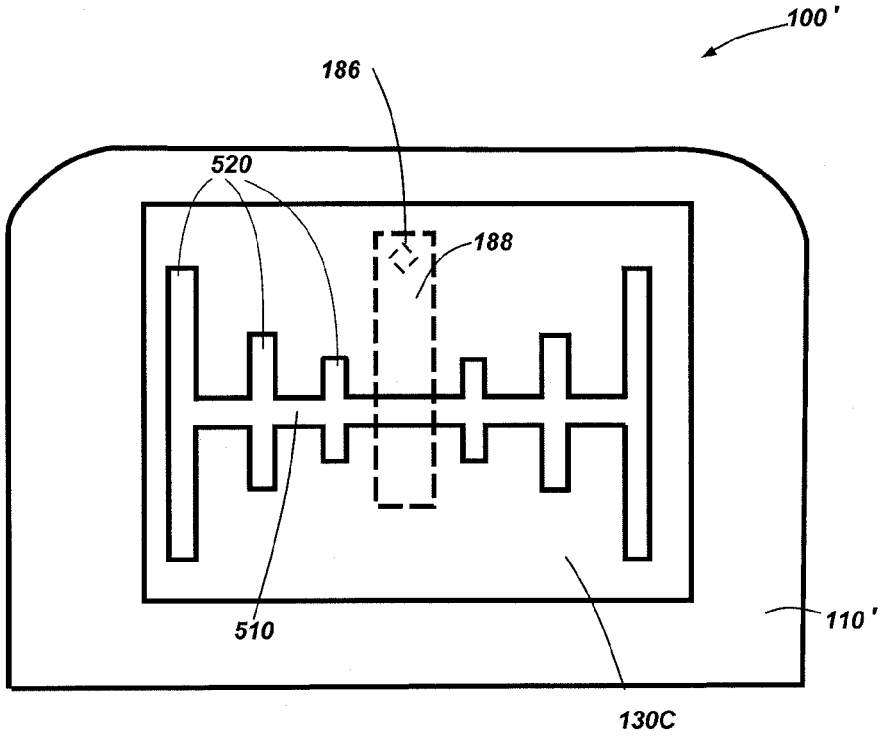
FIGS. 7A and 7B illustrate a patch antenna according to another embodiment of the present invention.
Figure 7B:
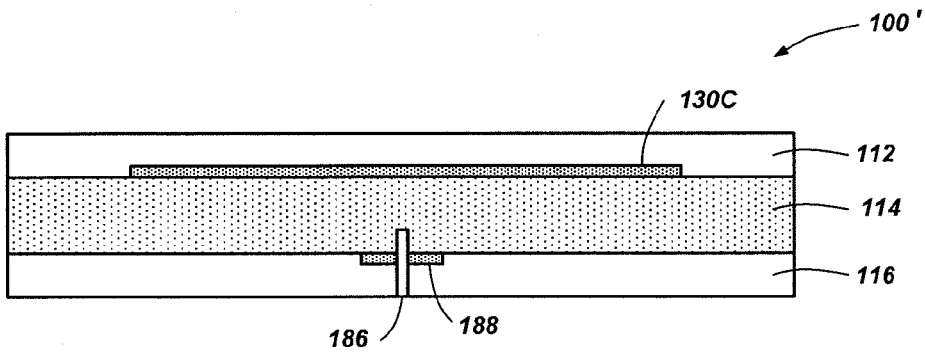

FIGS. 7A and 7B illustrate a patch antenna 100' according to another embodiment of the present invention. In the embodiment of FIGS. 7A and 7B, the patch antenna 100' includes a dielectric substrate 110, a lower patch 188 and a "razor patch" 130C. The razor patch is so named for its resemblance to a razor blade. The razor patch 130C includes a longitudinal slot 510 with transverse slots 520 disposed at intervals along both sides of the longitudinal slot 510. The width, length, and placement of the longitudinal slot 510 and transverse slots 520 may be modified to adjust resonance characteristics and increase bandwidth of the patch antenna 100'.

As stated earlier, one method for increasing bandwidth in a patch antenna is to separate the patches by a larger distance. However, conventional foam and air separators may be more difficult to manufacture and less rugged. In the embodiment of FIGS. 7A and 7B, a larger separation between the lower patch 188 and the razor patch 130C is achieved by creating a laminar substrate with a relatively low permittivity plastic spacer 114 sandwiched between an upper dielectric substrate 112 and a lower dielectric substrate 116. There may be many suitable dielectric substrates. As a non-limiting example, one suitable substrate for the upper dielectric substrate 112 and the lower dielectric substrate 116 is PTFE. Thus, the razor patch 130C may be formed on the upper dielectric substrate 112 and the lower patch 188 may be formed on the lower dielectric substrate 116. The upper dielectric substrate 112 and lower dielectric substrate 116 may then be affixed to opposite sides of the plastic spacer 114. The plastic spacer 114 is configured with a relatively dense plastic that is easily machineable relative to a foam spacer.

As with the embodiment of FIGS. 2A and 2B, the embodiment of FIGS. 7A and 7B includes a feed-through connection 186. However, in patch antenna 100', the feed-through connection 186 only needs to connect to the lower dielectric substrate 116. Thus, the feed-through connection 186 extends through the lower dielectric substrate 116 and connects with the lower patch 188. The feed-through connection 186 may extend partially into the plastic spacer 114 to add strength and additional alignment capability when a conductive feed-through pin is inserted in the feed-through connection 186.

In a transmit operation, an electromagnetic signal is input through the feed-through connection 186 onto the lower patch 188. The lower patch 188 radiates the signal, which is electromagnetically coupled to the razor patch 130C. The razor patch 130C then radiates the electromagnetic signal out as the antenna output. In a receive operation, the razor patch 130C receives external electromagnetic radiation, which is electromagnetically coupled to the lower patch 188 and onto the feed-through connection 186.

Figure 8:
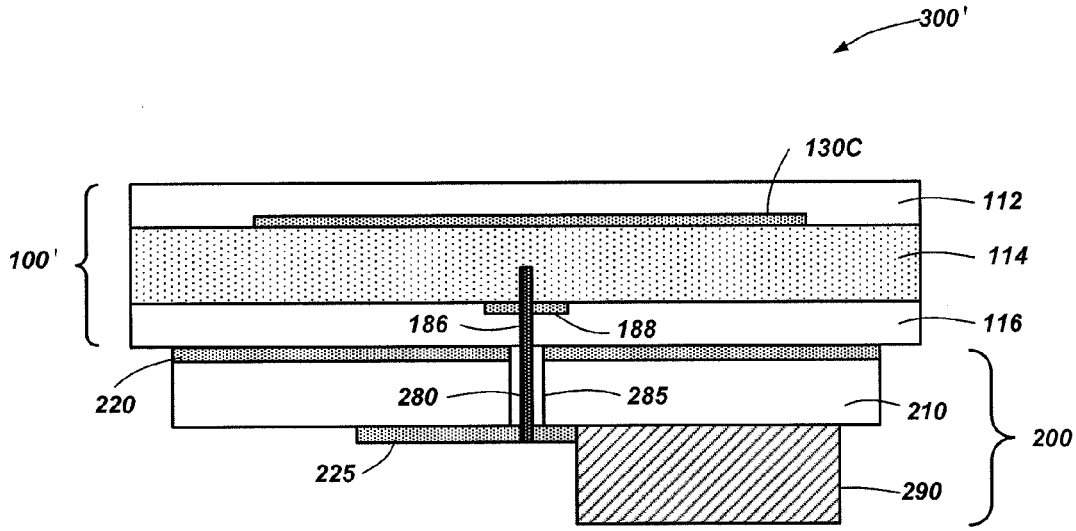
FIG. 8 illustrates a side view of an antenna system including a razor patch antenna and a transceiver board according to one or more embodiments of the present invention.

FIG. 8 illustrates a side view of an antenna system 300' including a patch antenna 100' and transceiver board 200 according to one or more embodiments of the present invention. The transceiver board is the same as that described above with reference to FIGS. 3-5.

The patch antenna 100' and the transceiver board 200 are configured to be abutted against one another such that the lower dielectric substrate 116 of the patch antenna 100 connects with the ground plane 220 of the transceiver board 200. Furthermore, the first feed-through conductor 186 aligns with the second feed-through conductor 280 to form a continuous impedance-controlled signal connection between the lower patch 188 and the transceiver device 290 on the transceiver board 200.

As non-limiting examples, patch antenna 100' and the transceiver board 200 may be coupled together with a conductive paste, a conductive adhesive, a non-conductive adhesive, or combinations thereof.

The first feed-through conductor 180 and the second feed-through conductor 280 may be coupled as a solder connection. Alternatively, a conductive feed-through pin may act as both the first feed-through conductor 180 and the second feed-through conductor 280 and be soldered into place within the insulated hole 285 and first feed-through conductor hole 186.

Figure 9:
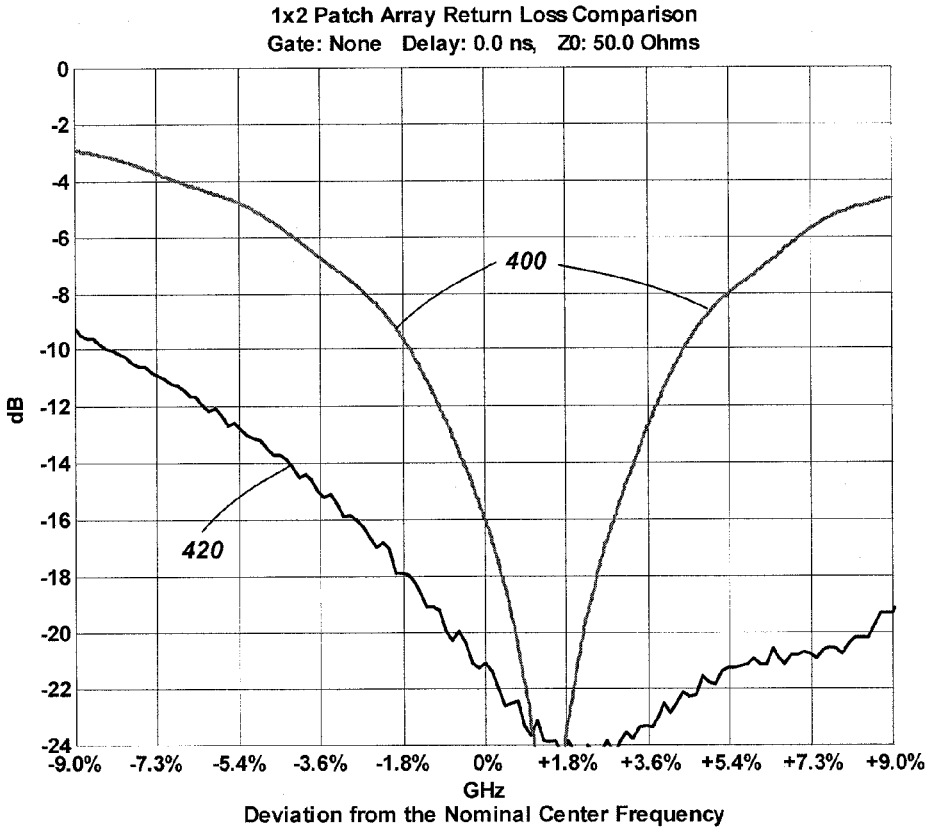
FIG. 9 is a graph illustrating return loss for the patch antenna of FIGS. 7A and 7B.

FIG. 9 is a graph illustrating return loss for the patch antenna of FIGS. 7A and 7B. The return loss is illustrated as deviation from a nominal frequency. As a non-limiting example, the nominal frequency for the patch antenna of FIGS. 7A and 7B may be about 5.6 GHz. A conventional return loss 400 is illustrated for a 1 X 2 patch array without tuning slots configured to resonate at about the same frequency and with the same dielectric substrate 110' as the embodiment of the present invention illustrated in FIGS. 7A and 7B. Return loss 420 illustrates response characteristics of the razor patch 130C antenna of FIGS. 7A and 7B including the tuning slots 155. As can be seen, return loss 400 provides for significant bandwidth improvement over the conventional return loss 400. For example, at a return loss of −20 dB, relative to the conventional return loss 400, the razor patch antenna return loss 420 has a bandwidth that is about 1.5% broader on the low-frequency side and about 6.2% broader on the high-frequency side to give an overall bandwidth increase of about 7.7%. As another example, at a return loss of −22 dB, relative to the conventional return loss 400, the razor patch antenna return loss 410 has a bandwidth that is about 0.7% broader on the low-frequency side and about 2.8% broader on the high-frequency side to give an overall bandwidth increase of about 3.5%.

It should be understood that any reference to an element herein using a designation such as "first," "second," and so forth does not generally limit the quantity or order of those elements. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise a set of elements may comprise one or more elements.

Although the present invention has been described with reference to particular embodiments, the present invention is not limited to these described embodiments. Rather, the present invention is limited only by the appended claims and their legal equivalents.

What is claimed is:

1. A patch antenna, comprising:

a dielectric substrate having a first surface and a second surface;

a grounding conductor plane formed on the first surface of the dielectric substrate; and one or more patch radiators formed in a rectangular shape on the second surface of the dielectric substrate, each of the one or more patch radiators, comprising:

a feed point operably coupled to an edge of the patch radiator;

a first tuning slot extending from a first edge of the patch radiator toward an interior section of the patch radiator; and a second tuning slot extending from the first edge toward the interior section of the patch radiator parallel to the first tuning slot, the first tuning slot and second tuning slot configured in combination to modify a bandwidth of the patch antenna.

2. The patch antenna of claim 1, wherein the one or more patch radiators formed on the second surface of the dielectric substrate comprise an array of a plurality of patch radiators.

3. The patch antenna of claim 1, wherein the feed point is operably coupled to the first edge of the one or more patch radiators and is positioned near a center of the first edge, and wherein:

the first tuning slot extends from the first edge on one side of the feed point; and the second tuning slot extends from the first edge on another side of the feed point.

4. The patch antenna of claim 1, wherein the first edge of the one or more patch radiators is positioned on a side of the rectangular shape opposite from the edge that the feed point is coupled to.

5. The patch antenna of claim 1, wherein the first edge of the one or more patch radiators is positioned on at least one side of the rectangular shape adjacent to the edge that the feed point is coupled to.

6. The patch antenna of claim 1, wherein the dielectric substrate comprises a PTFE (polytetrafluoroethylene) substrate.

7. The patch antenna of claim 1, further comprising a feed-through conductor disposed through the dielectric substrate and the grounding conductor plane, electrically insulated from the grounding conductor plane, and operably coupled to the feed point.

8. A patch antenna, comprising:

a grounding conductor plane disposed on a first surface of a dielectric substrate;

a patch radiator disposed on a second surface of the dielectric substrate, the patch radiator comprising:

a feed point operably coupled to an edge of the patch radiator;

a first tuning slot extending from a first edge of the patch radiator toward an interior section of the patch radiator; and a second tuning slot extending from the first edge toward the interior section of the patch radiator parallel to the first tuning slot, the first tuning slot and second tuning slot configured in combination to modify a bandwidth of the patch antenna;

a feed-through conductor disposed through the dielectric substrate and the grounding conductor plane and electrically insulated from the grounding conductor plane; and a feed line operably coupling the feed-through conductor to the feed point of the patch radiator.

9. The patch antenna of claim 8, wherein the feed line operably couples to the patch radiator at the first edge of the patch radiator that the first tuning slot and second tuning slot extend from.

10. The patch antenna of claim 8, wherein the patch radiator comprises a rectangular shape.

11. The patch antenna of claim 8, wherein a length, a width, a location, or a combination thereof for the pair of tuning slots is selected to increase a bandwidth of the patch antenna.

12. A patch antenna, comprising:

a first dielectric substrate having a first patch radiator disposed thereon;

a second dielectric substrate having a razor patch radiator disposed thereon;

a plastic spacer substrate having a first side and a second side and sandwiched between the first dielectric substrate and the second dielectric substrate, wherein the first radiator patch abuts the first side and the razor patch radiator abuts the second side; and a feed-through conductor disposed through the first dielectric substrate and operably coupled to the first patch radiator.

13. The patch antenna of claim 12, wherein the razor patch radiator is a rectangular shape and comprises:

a longitudinal slot within a border of the rectangular shape and in a first direction; and one or more transverse slots within the border of the rectangular shape perpendicular to, and intersecting, the longitudinal slot.

14. The patch antenna of claim 13, wherein a length, a width, or a combination thereof for the longitudinal slot is selected to increase a bandwidth of the patch antenna.

15. The patch antenna of claim 13, wherein a length, a width, or a combination thereof for the one or more transverse slots is selected to increase a bandwidth of the patch antenna.

16. An antenna system, comprising:

a patch antenna, comprising:

a grounding conductor plane disposed on a first surface of a dielectric substrate;

a patch radiator disposed on a second surface of the dielectric substrate;

a first feed-through conductor disposed through the dielectric substrate and electrically insulated from the grounding conductor plane; and a feed line operably coupling the feed-through conductor to the patch radiator; and a transceiver board, comprising:

a transceiver substrate;

a ground plane at least partially covering one surface of the transceiver substrate;

a second feed-through conductor disposed through the transceiver substrate and electrically insulated from the ground plane; and a transceiver device disposed on another surface of the transceiver substrate and operably coupled to the second feed-through conductor;

wherein the transceiver board is disposed adjacent the patch antenna such that the ground plane abuts and electrically couples to the grounding conductor plane and the first feed-through conductor operably couples to the second feed-through conductor.

17. The antenna system of claim 16, wherein the transceiver device comprises a monolithic microwave integrated circuit.

18. The antenna system of claim 16, wherein the transceiver device is selected from the group consisting of a device configured to receive transmissions, a device configured to send transmissions, and a device configured to receive and send transmissions.

19. The antenna system of claim 16, further comprising a conductive feed-through pin disposed through a first insulated hole for the first feed-through conductor and a second insulated hole for the second feed-through conductor.

20. An antenna system, comprising:

a patch antenna, comprising:

a first dielectric substrate having a first surface, a second surface, and a first patch radiator disposed on the first surface;

a second dielectric substrate having a razor patch radiator disposed thereon;

a plastic spacer substrate having a third surface and a fourth surface and sandwiched between the first dielectric substrate and the second dielectric substrate, wherein the first surface abuts the third surface and the razor patch radiator abuts the fourth surface; and a first feed-through conductor disposed through the first dielectric substrate and operably coupled to the first patch radiator; and a transceiver board, comprising:

a transceiver substrate;

a ground plane at least partially covering one surface of the transceiver substrate;

a second feed-through conductor disposed through the transceiver substrate and electrically insulated from the ground plane; and a transceiver device disposed on another surface of the transceiver substrate and operably coupled to the second feed-through conductor;

wherein the transceiver board is disposed adjacent the patch antenna such that the ground plane abuts the second surface and the first feed-through conductor operably couples to the second feed-through conductor.

21. The antenna system of claim 20, wherein the transceiver device comprises a monolithic microwave integrated circuit.

22. The antenna system of claim 20, wherein the transceiver device is selected from the group consisting of a device configured to receive transmissions, a device configured to send transmissions, and a device configured to receive and send transmissions.

23. The antenna system of claim 20, further comprising a conductive feed-through pin disposed through a first insulated hole for the first feed-through conductor and a second insulated hole for the second feed-through conductor.

* * * * *

UNITED STATES PATENT AND TRADEMARK OFFICE

CERTIFICATE OF CORRECTION

PATENT NO. : 8,232,924 B2
APPLICATION NO. : 12/465835
DATED : July 31, 2012
INVENTOR(S) : Steven Bucca and Mike Gawronski It is certified that error appears in the above-identified patent and that said Letters Patent is hereby corrected as shown below:

In the specification:

COLUMN 6, LINE 62, change "substrate 110," to --substrate 110′,--
COLUMN 7, LINE 50, change "antenna 100" to --antenna 100′--

Signed and Sealed this
Twenty-fourth Day of September, 2013

Teresa Stanek Rea
*Deputy Director of the United States Patent and Trademark Office*